United States Patent [19]

Leifeld

[11] Patent Number: 4,709,451

[45] Date of Patent: Dec. 1, 1987

[54] METHOD AND APPARATUS FOR FEEDING A FIBER TUFT OPENER OR CLEANER

[75] Inventor: Ferdinand Leifeld, Kempen, Fed. Rep. of Germany

[73] Assignee: Trützschler GmbH & Co. KG, Monchen-Gladbach, Fed. Rep. of Germany

[21] Appl. No.: 915,128

[22] Filed: Oct. 3, 1986

[30] Foreign Application Priority Data

Oct. 5, 1985 [DE] Fed. Rep. of Germany ..... 3535684

[51] Int. Cl.[4] ..... D01G 15/40

[52] U.S. Cl. ..... 19/105; 19/240

[58] Field of Search ..... 19/105, 240, 300

[56] References Cited

U.S. PATENT DOCUMENTS

| | | | |
|---|---|---|---|
| 3,709,406 | 1/1973 | Binder et al. | 19/105 X |
| 4,030,635 | 6/1977 | Hablützel et al. | 19/105 X |
| 4,161,052 | 7/1979 | Erben | 19/105 X |
| 4,321,732 | 3/1982 | Erben | 19/240 |
| 4,438,548 | 3/1984 | Grunder | 19/240 X |
| 4,506,413 | 3/1985 | Leifeld | 19/240 X |
| 4,535,511 | 8/1985 | Leifeld et al. | 19/105 |
| 4,574,433 | 3/1986 | Brunnschweiler | 19/105 |

FOREIGN PATENT DOCUMENTS

| | | |
|---|---|---|
| 122717 | 10/1984 | European Pat. Off. . |
| 2031788 | 6/1970 | Fed. Rep. of Germany . |
| 2506061 | 9/1975 | Fed. Rep. of Germany . |
| 2704241 | 1/1980 | Fed. Rep. of Germany . |
| 2905589 | 8/1980 | Fed. Rep. of Germany . |
| 500936 | 2/1939 | United Kingdom . |
| 995652 | 6/1965 | United Kingdom . |
| 1497925 | 1/1978 | United Kingdom . |
| 2019914 | 11/1979 | United Kingdom . |
| 1594432 | 7/1981 | United Kingdom . |
| 2067608 | 7/1981 | United Kingdom . |
| 2100304 | 12/1982 | United Kingdom . |

*Primary Examiner*—Louis K. Rimrodt
*Assistant Examiner*—J. L. Olds
*Attorney, Agent, or Firm*—Spencer & Frank

[57] ABSTRACT

An apparatus includes a fiber tuft feeder with discharge rollers for delivering a fiber tuft mass; a drive motor connected to the discharge rollers; a feeding device arranged for advancing fiber material obtained from the tuft feeder; and a textile processing machine having an input arranged to receive fiber material from the feeding device. An opening roller forms part of the tuft feeder and is arranged downstream of the discharge rollers for receiving fiber material from the discharge rollers and to advance fiber tufts. Devices produce a loose fiber tuft mass from the fiber tufts delivered by the opening roller, form a thin fiber lap from the loose mass and advance the fiber lap to the feeding device. A sensor is situated upstream of the textile processing machine for detecting fluctuations in quantity characteristics of the advancing fiber lap, and a transducer is connected to the sensor for generating electric signals representing the fluctuations. A regulator is connected to the transducer and the drive motor for regulating the rpm thereof as a function of the electric signals.

10 Claims, 6 Drawing Figures

METHOD AND APPARATUS FOR FEEDING A FIBER TUFT OPENER OR CLEANER

BACKGROUND OF THE INVENTION

This invention relates to a method and an apparatus for feeding a fiber tuft opener or cleaner associated with a fiber tuft feeder which forms a fiber lap or mat to be introduced into the opener or cleaner. Since the invention may find application in connection with a textile machine such as a cleaner or an opener, which, as the input material, uses a fiber lap, hereafter any reference to a cleaner should be understood to apply to an opener or similar apparatus as well.

The efficiency of a fiber tuft cleaner depends to a great measure on the quality of the fiber lap introduced thereinto. Therefore, a uniformity of the fiber lap both in the width and longitudinal directions is of importance. In a known apparatus, the fiber lap is produced by deflecting the fiber columns formed in the feed chute of the tuft feeder. The feed chute may be of the pneumatic type in which the fiber column is compressed by an air stream. The thickness of the fiber column depends from the pressure of the compressing air stream and from the mutual distance of the chute walls. In other types of feed chutes, the column is formed in the feed chute by a free fall of the fiber tufts. In such a case the lap thickness depends from the fill height of the tufts and from the mutual distance of the feed chutes walls.

In case of a feed chute of the free fall type, the minimum obtainable lap thickness is limited: the chute requires a minimum distance between the chute walls to ensure that the fiber material is capable of sliding downwardly without forming bridges between the walls which would lead to a lack of homogeneity of the fiber column. In the case of pneumatic feed chutes in which the distance between the chute walls may be substantially smaller than in the chutes of the free fall type, a limitation exists since the feed chute requires a certain air throughput to ensure the downward slide of the fiber material and its corresponding densification. By virtue of the tuft compression, however, between the narrow feed chute walls a significantly heavier material layer is present than in the chutes of the free fall type. Thus, in the known methods, it is not feasible to produce the desired, thin, uniform fiber lap for the cleaner. It has been found that photocells provided in the chutes of the free fall type for monitoring the filling height have required such fill height fluctuations for the operation of the machine that even the smallest fill heights have produced an excessively dense fiber lap.

SUMMARY OF THE INVENTION

It is an object of the invention to provide an improved method and apparatus with which the discussed disadvantages are eliminated and which thus produce a uniform fiber lap permitting a significantly improved cleaning or opening process.

This object and others to become apparent as the specification progresses, are accomplished by the invention, according to which, briefly stated, the tuft feeder delivers a loose mass of fiber tufts from which a thin and light fiber lap is formed; the lap thickness or lap weight—hereafter also termed as quantitative characteristics—is measured in the zone between the tuft feeder and the opening roller of the cleaner and, as a function of the lap thickness or weight, the rpm of the drive for the fiber lap advancing rollers (discharge rollers) of the fiber tuft feeder is varied.

Thus, according to the invention, uniform thin fiber laps are provided which are required by the high efficiency cleaners, and the laps may be introduced into the cleaner at high speeds. In the zone between the fiber tuft feeder situated upstream of the cleaner and the opening roller thereof the fiber thickness (in millimeter) or the fiber weight (in gram) is determined. As a function of the quantitative characteristics of the fiber lap, the material transport of the fiber feeder is accelerated or slowed down. The efficiency of the cleaner is improved because of the small thickness of the fiber lap. To obtain a high output, the thin fiber lap is introduced at high speeds. It is thus more advantageous to introduce into the cleaner a relatively thin lap at relatively high speed than - as in prior art arrangements - to feed to the cleaner a relatively thick lap at relatively low speeds. By virtue of the invention, limits of lap thicknesses are reduced, that is, thin laps of a thickness of, for example, 30 mm are possible which have not been feasible in known processes. In this manner, significant advantages are achieved concerning the degree of fiber tuft cleaning performed by the cleaner. Further, the opening of the fiber tufts is thereby significantly improved.

The lap thickness may be determined by means of a feeler roller arranged in the zone of the already deflected lap or by measuring the distance variation of the feed roller pair which is associated with the cleaner and whose rollers are resiliently pressed to one another. In order to ensure a disturbance-free passage of the fiber material, it is expedient to connect the drive of the feed roller for the cleaner and the drive of the discharge rollers of the upstream arranged fiber tuft delivering machine in an rpm-dependent manner to ensure that both drives are controlled together at high speeds and during required rpm changes. The drive for the discharge rollers of the tuft feeder is thus assigned a basic rpm which is similar to the rpm of the feed roller for the cleaner. On the signal producing such an rpm there is superposed a further signal which is derived from the thickness measuring arrangement so that upon deviation of the lap thickness in a sense of increase, the rpm of the discharge rollers of the lap feeder is decreased and conversely.

The apparatus according to the invention includes a fiber tuft feeder with discharge rollers and a feeding device for introducing the fiber lap into the cleaners. The discharge rollers of the tuft feeder cooperate with an opening roller, downstream of which there is arranged a device for forming and advancing a thin fiber lap and wherein the output amplifier of the drive motor for the discharge rollers of the tuft feeder are connected by means of a regulator with a measuring device for determining the thickness or weight of the fiber lap. Expediently, the measuring device comprises a feeler roller which, by direct contact, determines the thickness of the fiber lap. The feeler roller may be arranged upstream of the feed roller of the cleaner, or the feeler roller may be a floatably supported feed roller of the cleaner which cooperates with a second, stationary feed roller or a fixed feed tray. Preferably, the output amplifier of the drive motor for the discharge rollers of the tuft feeder is connected with a tachogenerator or pulse generator which is associated with the feed rollers of the cleaner. Advantageously, between the tachogenerator or pulse generator and the output amplifier for the drive motor there is provided an adding device for the desired rpm values.

According to a preferred embodiment in which the feeding device for the cleaner is provided with two feed rollers, one of the feed rollers is floatably supported and is coupled with a measuring device which senses the excursions of the floatable feed roller and which is connected by a control device with the drive motor of the other, stationarily supported feed roller. This arrangement further diminishes the irregularities still present in the fiber lap. In case undesired thick portions in the lap are still present, then by means of regulating the intake speed with which the fiber lap is introduced into the cleaner, it is ensured that a charging of the cleaner roller with fiber material will not be timewise greater than if the fiber lap with the thickened location were to be introduced with unchanged speed. The apparatus thus leads to a further improvement of the effects which are achieved by the relatively thin, rapidly advanced fiber laps. The limits for a timewise constant feed to the cleaner roller are maintained between narrower limits.

According to the invention, a thin fiber lap has advantages in the fiber opening and cleaning process. As a tooth of the opening roller is charged with a fiber tuft after penetrating into the fiber lap, it is desirable that the tooth emerge from the fiber lap as soon as possible rather than being compelled to dig a path for an extended period through the lap. Unifrom charging of all teeth enhances the opening and cleaning. Such result may be achieved in a more accurate manner by providing, according to the invention, relatively thin and relatively rapidly advanced laps and a timewise uniform feed of the lap.

According to a further feature of the invention, an rpm presetting device is connected with separate adding devices to which the regulator or the control device is connected downstream thereof.

DESCRIPTION OF THE PREFERRED EMBODIMENTS

Figure 1:
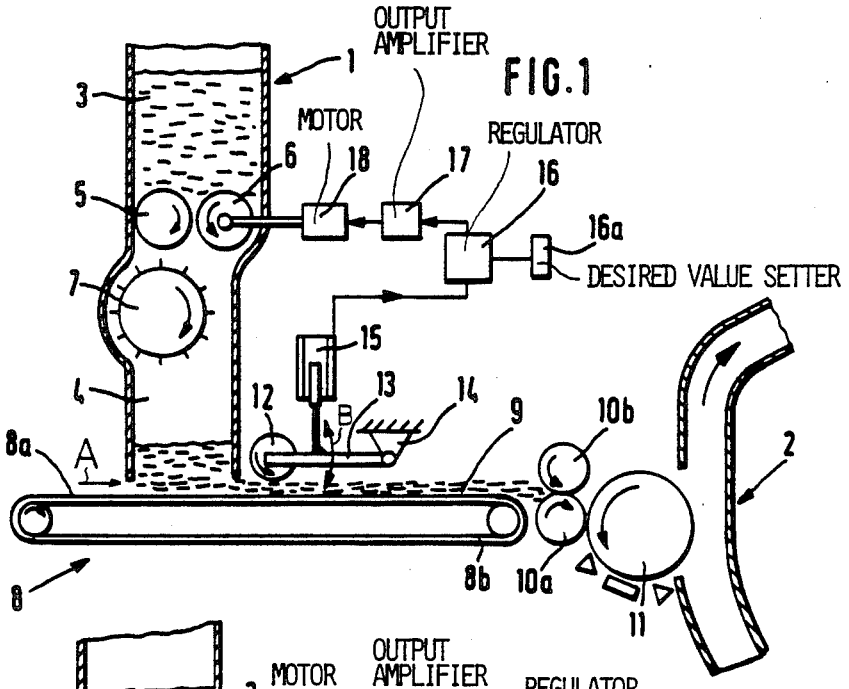
FIG. 1 is a schematic side elevational view, with block diagram, of a preferred embodiment of the invention.

Turning to FIG. 1, the embodiment illustrated therein comprises a fiber tuft feeder 1, operatively connected to a fiber cleaner 2, upstream thereof. The tuft feeder 1 has an upper reserve chute 3 and a lower feed chute 4 as well as two feed rollers (discharge rollers) 5 and 6 which advance the fiber tufts from the reserve chute 3 to an opening roller 7 which, in turn, advances the fiber tufts into the feed chute 4. Between the feed chute 4 and the cleaner 2 there is arranged an apparatus generally designated at 8 for forming and advancing a thin fiber tuft lap 9. The apparatus 8 essentially comprises an endless conveyor belt whose one end **8*a* is situated underneath the downwardly open feed chute 4 while its opposite end 8*b* reaches into the zone of feed rollers 10*a* and 10*b* of the opening roller 11 associated with the cleaner 2. The fiber tufts drawn by the feed rollers 5 and 6 of the tuft feeder 1 are opened into individual fiber tufts by the rapidly rotating opening roller 7. The fiber tufts fall on the upper reach of the belt 8 (which is driven in the direction of the arrow A) and form there a thin fiber lap 9 which is advanced on the belt 8 to feed rollers 10*a*, 10*b* which draw the fiber lap and advance it to the rapidly rotating opening roller 11**.

Above the lap forming and advancing apparatus 8 there is provided a measuring device comprising a rotary feeler roller 12 which, with its cylindrical surface, lies on the top of the fiber lap 9 advanced on the conveyor belt 8. The feeler roller 12 is supported at one end of a lever 13 which, at its other end, is pivotally secured to a stationary support 14. With the lever 13 there is associated an analog path sensor (transducer) 15 such as an inductive plunger coil with a plunger armature which converts the excursions of the feeler roller 12 (indicated by the double-headed arrow B) into electric pulses. The path sensor 15 is electrically connected with a regulator (or rpm setter) 16 which has a desired value setter **16*a*. The regulator 16 applies its output signals to an output amplifier 17 of an rpm-variable drive motor 18 for the feed roller 6. This arrangement ensures that the tuft feeding apparatus 1 delivers a loose fiber tuft mass from which a thin and light fiber tuft lap 9 is formed and wherein the lap thickness or lap weight in the zone between the tuft feeder 1 and the opening roller 11 of the cleaner 2 is measured and, as a function of the lap thickness or lap weight, the rpm of the drive motor 18 associated with the feed rollers 5, 6 of the tuft feeder 1** is varied.

Figure 2:
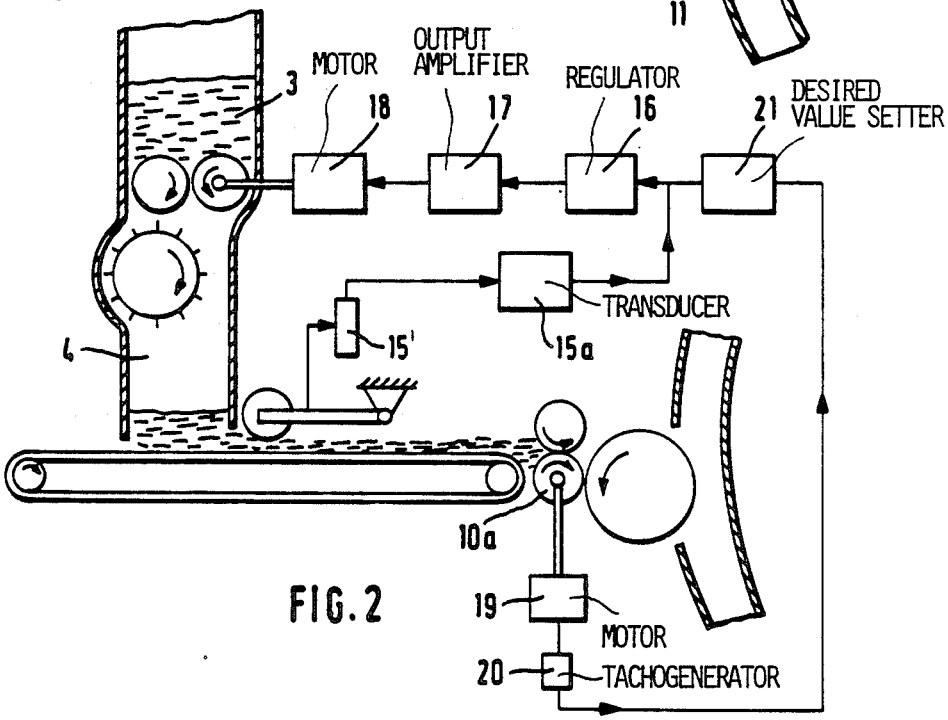
FIG. 2 is a schematic side elevational view, with block diagram, of another preferred embodiment of the invention.

In the embodiment according to FIG. 2, the sensor 15' comprises a sliding resistor connected to a transducer **15*a*. Further, the drive motor 19 for the feed roller 10a of the cleaner 2 is associated with a tachogenerator 20 whose output signals are applied to a desired value setter 21 for a regulator 16**. In this manner, the regulating circuit is affected by a follow-up control.

Figure 3:
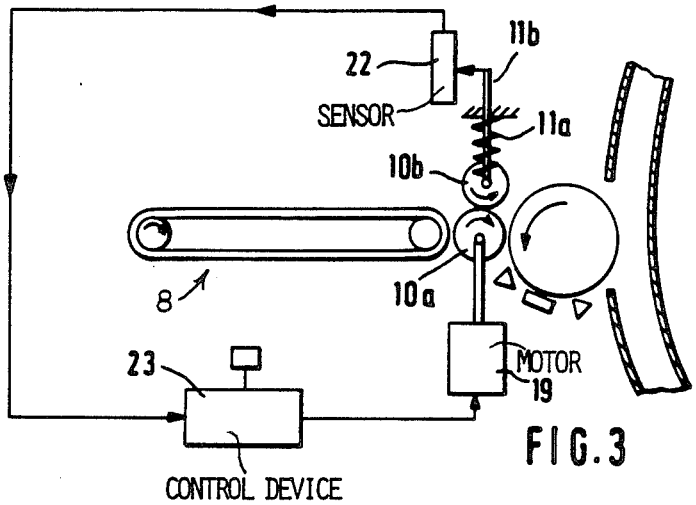
FIG. 3 is a schematic side elevational view, with block diagram, of still another preferred embodiment of the invention.

In the embodiment illustrated in FIG. 3, the upper feed roller **10*b* of the cleaner 2 is biased by a compression spring 11*a* and has a holder element 11*b* with which there is connected a sensor (measuring device) 22*b* such as a sliding resistor, for converting the local excursions of the floating feed roller 10*b* into electric pulses. The sensor 22 is connected, with the intermediary of a control device 23, with the drive motor 19 for the other, stationary feed roller 10*b*. It is to be understood that it is feasible to connect both feed rollers 10*a* and 10*b* with the drive motor 19**.

Figure 4:
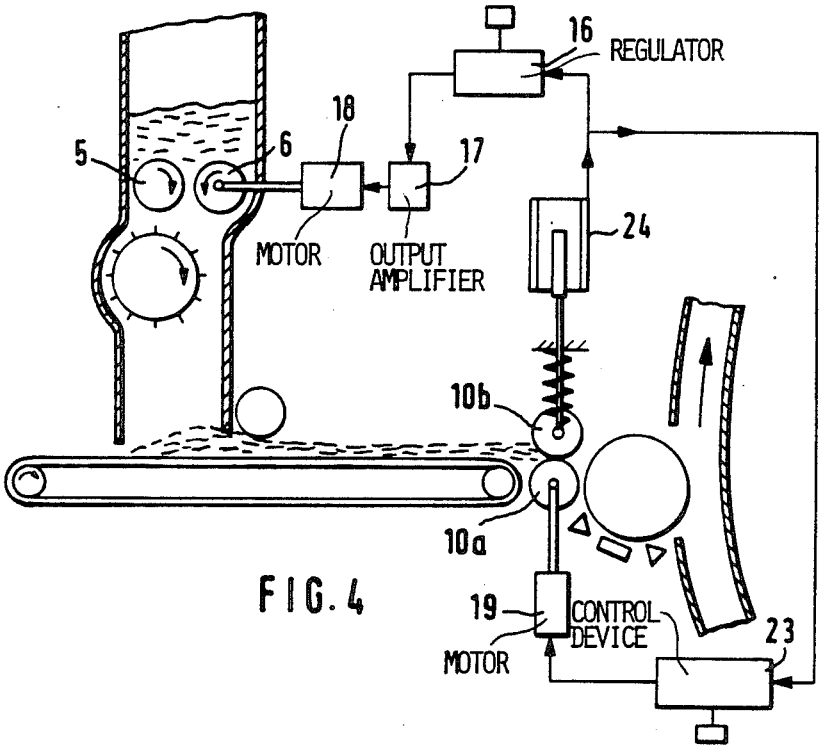
FIG. 4 is a schematic side elevational view, with block diagram, of a further preferred embodiment of the invention, similar to the embodiment illustrated in FIG. 3.

In the embodiment illustrated in FIG. 4, a measuring device 24 is provided which is formed of a plunger coil cooperating with a plunger armature. The measuring device 24 is connected with the drive motor 19 for the feed rollers **10*a*, 10*b* of the cleaner 2 and, with the intermediary of a regulator 16, with the drive motor 18 for the feed rollers 5, 6 of the tuft feeder 1. In this manner, there is provided a combined control chain for the feed rollers 10***a*, 10*b* with a regulating circuit for the feed rollers 5 and 6.

Figure 5:
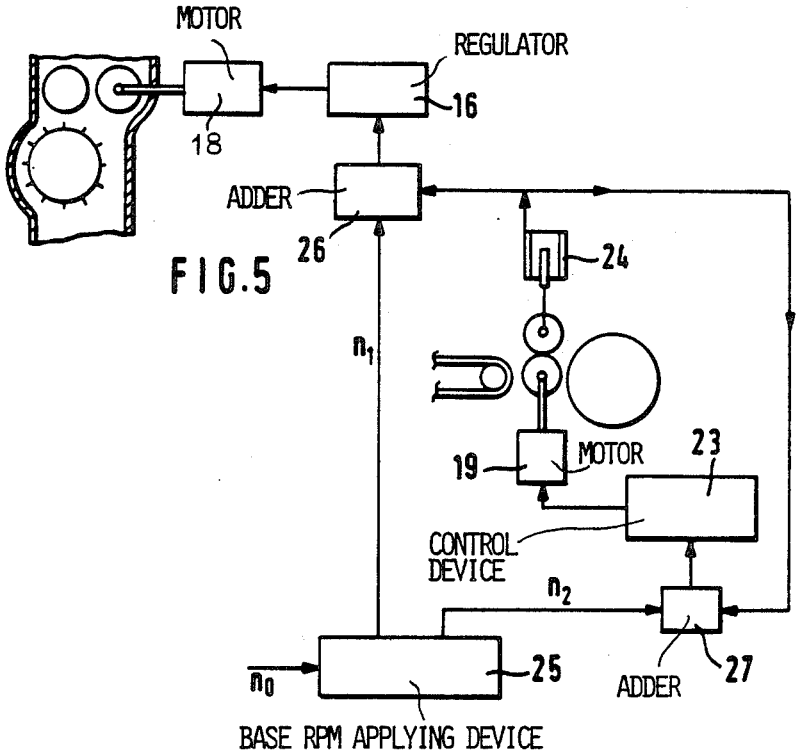
FIG. 5 is a schematic side elevational view, with block diagram, of still another preferred embodiment of the invention, similar to the embodiment illustrated in FIG. 4.

FIG. 5 illustrates a system similar to that of FIG. 4, including an arrangement for applying a basic rpm $n_0$. Between the measuring device 24 and the regulator 16 there is provided an adder 26 and between the measuring device 24 and the control device 23 there is provided an adder 27. A base rpm applying device 25 for the rpm $n_0$ is connected with the adder 26 for applying a base rpm $n_1$ and in connected with the adder 27 for applying a base rpm $n_2$.

Figure 6:
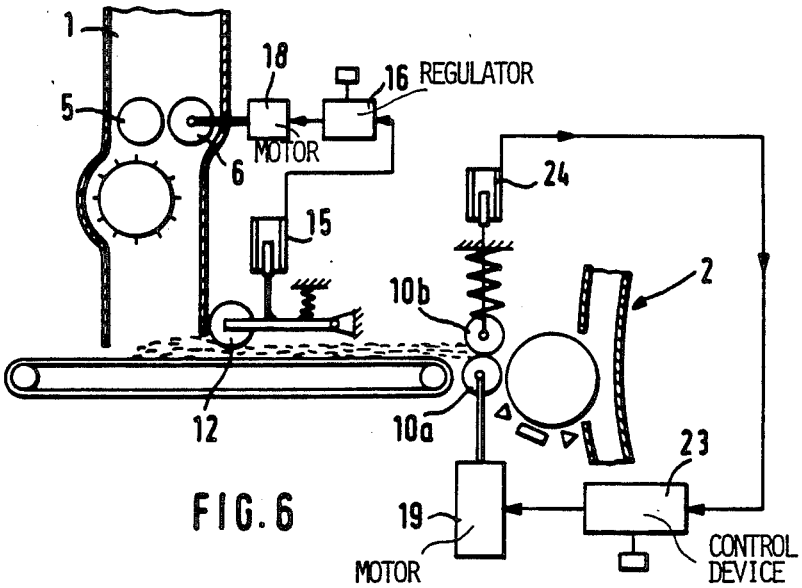
FIG. 6 is a schematic side elevational view, with block diagram, of yet another embodiment of the invention, comprising a combination of the embodiments illustrated in FIGS. 1 and 3.

In the embodiment according to FIG. 6 a control arrangement of the type illustrated in FIG. 3 is connected downstream of a control arrangement illustrated in FIG. 1. In this manner, the advantages of the regulating circuit, that is, the production of a uniformly thin fiber lap is combined with the advantages of a control device which provides for a uniform feed of the lap to the cleaner.

As a measuring magnitude for the fiber lap 9 either the thickness or the weight may be utilized.

The present disclosure relates to subject matter contained in Federal Republic of Germany Patent Application No. P 35 35 684.7 (filed Oct. 5, 1985) which is incorporated herein by reference.

It will be understood that the above description of the present invention is susceptible to various modifications, changes and adaptations, and the same are intended to be comprehended within the meaning and range of equivalents of the appended claims.

What is claimed is:

1. A method of feeding a fiber lap to an opening roller of fiber processing machine, comprising the following steps:

(a) delivering fiber tufts by discharge rollers forming part of a fiber tuft feeder;

(b) forming a loose fiber tuft mass from the fiber tufts delivered by the discharge rollers;

(c) forming a thin fiber lap from the loose fiber tuft mass by depositing the loose fiber mass on a traveling conveying surface;

(d) advancing the fiber lap by the conveying surface to said opening roller;

(e) sensing fluctuations in quantity characteristics of the running fiber lap at a location situated upstream of the opening roller as viewed in the direction of fiber lap advance;

(f) generating electric signals representing said fluctuations; and (g) varying the rpm of said discharge rollers as a function of the electric signals for maintaining quantity characteristics of said fiber lap uniform.

2. In an apparatus including a fiber tuft feeder having cooperating fiber tuft discharge rollers arranged to deliver a fiber tuft mass; a drive motor, including an output amplifier, drivingly connected to at least one of said discharge rollers; an opening roller forming part of said tuft feeder and being arranged downstream of said discharge rollers as viewed in a direction of fiber tuft advance through said discharge rollers; said opening roller being arranged to receive fiber material from said discharge rollers and to advance fiber tufts; means, forming part of said tuft feeder, for making a loose fiber tuft mass from the fiber tufts delivered by said opening roller; said tuft feeder having an outlet opening through which the loose fiber tuft mass is discharged; a feeding device arranged for advancing fiber material obtained from said tuft feeder; and a textile processing machine having an input arranged to receive fiber material from said feeding device; the improvement comprising:

(a) a fiber lap forming and advancing apparatus including a travelling conveying surface extending from the tuft feeder to said feeding device; said surface having a portion situated underneath said outlet opening, whereby the loose fiber tuft mass is received on the surface and advanced therewith to said feeding device as a continuous, thin fiber lap;

(b) sensor means situated at a location upstream of said textile processing machine and downstream of said outlet opening of said tuft feeder for detecting fluctuations in quantity characteristics of the advancing fiber lap;

(c) transducer means connected to said sensor means for generating electric signals representing said fluctuations; and (d) regulator means operatively connected to said transducer means and said output amplifier for regulating the rpm of said drive motor as a function of said electric signals.

3. An apparatus as defined in claim 2, wherein said sensor means comprises a floatingly supported feeler roller contacting said fiber lap and arranged to undergo excursions as a function of thickness variations of the running fiber lap; said feeler roller being located upstream of said feeding device.

4. An apparatus as defined in claim 2, wherein said feeding device comprises a feed roller; further comprising a tachogenerator connected to said feeding device and arranged for generating signals representing the rpm of the feed roller; said tachogenerator being operatively connected with said regulator means for applying the signals of the tachogenerator to said regulator means.

5. An apparatus as defined in claim 4, further comprising a desired rpm value setter connected between said output amplifier and said tachogenerator.

6. An apparatus as defined in claim 2, wherein said feeding device comprises a feed roller and a backup component cooperating with the feed roller such that said fiber lap passes between said feed roller and said backup component; means for floatingly supporting said feed roller for allowing said feed roller to undergo excursions as a function of thickness variations of the fiber lap passing through the feeding device; and means for stationarily supporting said backup component; said feed roller forming part of said sensor means.

7. An apparatus as defined in claim 6, wherein said feed roller is a first feed roller and said backup component is a second feed roller.

8. In an apparatus including a fiber tuft feeder having cooperating fiber tuft discharge rollers arranged to deliver a fiber tuft mass; a first drive motor, including an output amplifier, drivingly connected to at least one of said discharge rollers; a feeding device arranged for advancing fiber material obtained from said tuft feeder; and a textile processing machine having an input arranged to receive fiber material from said feeding device; the improvement comprising (a) an opening roller forming part of said tuft feeder and being arranged downstream of said discharge rollers as viewed in a direction of fiber tuft advance through said discharge rollers; said opening roller being arranged to receive fiber material from said discharge rollers and to advance fiber tufts;

(b) means, forming part of said tuft feeder, for making a loose fiber tuft mass from the fiber tufts delivered by said opening roller;

(c) means for forming a thin fiber lap from said loose mass and for advancing the fiber lap to said feeding device;

(d) first and second cooperating feed rollers forming part of said feeding device and being arranged for forming a passage therebetween for the fiber lap;

(e) means for stationarily supporting said second feed roller;

(f) sensor means situated upstream of said textile processing machine for detecting fluctuations in quantity characteristics of the advancing fiber lap; said sensor means including said first feed roller and means for floatingly supporting said first feed roller for allowing said first feed roller to undergo excursions as a function of thickness variations of the fiber lap passing through the first and second feed rollers of the feeding device;

(g) transducer means connected to said sensor means for generating electric signals representing said fluctuations;

(h) regulator means operatively connected to said transducer means and said output amplifier for regulating the rpm of said first drive motor as a function of said electric signals;

(i) a second drive motor drivingly connected to said second feed roller; and (j) a control device connected to said transducer means and said second drive motor for receiving said electric signals from said transducer means and for regulating the rpm of said second drive motor as a function of said electric signals.

9. An apparatus as defined in claim 8, further comprising a base rpm applying device having an output connected to an input of a first adder connected between said transducer means and said control device; said base rpm applying device having a further output connected to an input of a second adder having an output connected to an input of said regulating means.

10. In an apparatus including a fiber tuft feeder having cooperating fiber tuft discharge rollers arranged to deliver a fiber tuft mass; a first drive motor, including an output amplifier, drivingly connected to at least one of said discharge rollers; a feeding device arranged for advancing fiber material obtained from said tuft feeder; and a textile processing machine having an input arranged to receive fiber material from said feeding device; the improvement comprising (a) an opening roller forming part of said tuft feeder and being arranged downstream of said discharge rollers as viewed in a direction of fiber tuft advance through said discharge rollers; said opening roller being arranged to receive fiber material from said discharge rollers and to advance fiber tufts;

(b) means, forming part of said tuft feeder, for making a loose fiber tuft mass from the fiber tufts delivered by said opening roller;

(c) means for forming a thin fiber lap from said loose mass and for advancing the fiber lap to said feeding device;

(d) first sensor means situated upstream of said feeding device and downstream of said tuft feeder for detecting fluctuations in quantity characteristics of the advancing fiber lap;

(e) first transducer means connected to said first sensor means for generating first electric signals representing said fluctuations;

(f) regulator means operatively connected to said first transducer means and said output amplifier for regulating the rpm of said first drive motor as a function of said first electric signals;

(g) first and second cooperating feed rollers forming part of said feeding device and being arranged for forming a passage therebetween for the fiber lap;

(h) means for floatingly supporting said first feed roller for allowing said first feed roller to undergo excursions as a function of thickness variations of the fiber lap passing through the first and second feed rollers of the feeding device; and means for stationarily supporting said second feed roller; said first feed roller and said means for floatingly supporting said first feed roller forming a second sensor means;

(i) a second transducer means connected to said second sensor means for generating second electric signals representing the thickness variations of said fiber lap passing through said first and seocnd feed rollers;

(j) a second drive motor drivingly connected to said second feed roller; and (k) a control device connected to said second transducer means and said second drive motor for receiving said second electric signals from said second transducer means and for regulating the rpm of said second drive motor as a function of said second electric signals.

* * * * *